US007485788B2

(12) United States Patent
Fennell et al.

(10) Patent No.: US 7,485,788 B2
(45) Date of Patent: Feb. 3, 2009

(54) COMBINATION CHIMES AND FAITH BUILDING MESSAGE SYSTEM

(76) Inventors: Dessie Merilyn Fennell, 515 Chestnut Blvd., Anderson, SC (US) 29625; Jessie Evelyn Hefner, 515 Chestnut Blvd., Anderson, SC (US) 29625

( * ) Notice: Subject to any disclaimer, the term of this patent is extended or adjusted under 35 U.S.C. 154(b) by 0 days.

(21) Appl. No.: 11/823,576

(22) Filed: Jun. 28, 2007

(65) Prior Publication Data

US 2009/0000458 A1 Jan. 1, 2009

(51) Int. Cl.
*G10D 13/08* (2006.01)

(52) U.S. Cl. ..... 84/402

(58) Field of Classification Search ..... 84/402–410
See application file for complete search history.

(56) References Cited

U.S. PATENT DOCUMENTS

| | | | | |
|---|---|---|---|---|
| D250,455 | S | 12/1978 | Mohrhauser | |
| D272,810 | S | 2/1984 | Stilson | |
| D285,669 | S | 9/1986 | Brockmann | |
| D297,129 | S | 8/1988 | Anderson | |
| D317,419 | S * | 6/1991 | Ronzheimer | D10/116 |
| D324,000 | S | 2/1992 | Kvistad | |
| D332,924 | S | 2/1993 | Schutze | |
| D346,986 | S | 5/1994 | Friess, Jr. | |
| 5,315,909 | A | 5/1994 | Hsu | |
| 5,450,779 | A | 9/1995 | Yancy | |
| 5,452,638 | A | 9/1995 | Yancy | |
| D362,819 | S | 10/1995 | Stannard | |
| D370,183 | S | 5/1996 | Christensen | |
| D373,547 | S | 9/1996 | Stratford | |
| 5,744,736 | A | 4/1998 | Chang | |
| D404,671 | S | 1/1999 | Stannard | |
| D405,709 | S | 2/1999 | Stannard | |
| D419,098 | S | 1/2000 | Evans | |
| 6,112,382 | A | 9/2000 | Parker et al. | |
| D432,936 | S | 10/2000 | Wing et al. | |
| 6,640,742 | B1 | 11/2003 | Grupp | |
| 2003/0047059 | A1 * | 3/2003 | Brown | 84/402 |

OTHER PUBLICATIONS

Davis Blanchard Wind Chimes 4409 Dunn St. Houston, Texas—davisblanchard.com.
Woodstock Chimes www.my-occ.com.
Christian Book Gifts. www.christianbook.com.

* cited by examiner

*Primary Examiner*—Kimberly R Lockett
(74) *Attorney, Agent, or Firm*—Robert R. Reed

(57) ABSTRACT

The present invention combines a classic chimes system with message bars having a faith building message imprinted on the message bars in keeping with the multi-tone chimes. In the preferred system the chimes and message bars hang vertically from a main support member. The message bars are spaced between the chimes so that a striker is free to contact each chime. The striker may have a wind or clapper vane hanging from the striker to move the striker in contact with the chimes. In one embodiment the message bars provide the clapper vane. Inspirational words and biblical phrases are also imprinted on the main support member and the wind vane. A faith bar, having a faith for healing and love message imprinted thereon, may also be added above the main support member bar to convey an overall faith building message for the system.

18 Claims, 10 Drawing Sheets

ART OF RECORD

ART OF RECORD

ART OF RECORD

Isaiah
53:5
In his stripes we are healed
75a

Genesis
18:14
Is anything too hard for Me?
75b

Matthew
19:26
With God all things are possible
75c

Mark
9:23
If thou canst believe, all things are possible to him that believeth
75d Psalms
103:3
Who healeth all thy diseases
75e Exodus
15:26
I am the Lord that healeth thee
75f Psalms
118:17
You shall not die but live
75g Psalms
91:16
With long life will I satisfy Him
75h 85a
Hebrews13:5
I will never
leave thee
or
forsake
thee 85b
Isaiah 49:16
I have graven
you on the
palms of
my
hands
85c
Isaiah 62:3
You are my
royal
diadem 85d
Isaiah 49:10
Fear not I
am with
thee 85e
Peter 5:7
Casting all
your care on
Him for He
careth for
you 85f
Psalms34:7
The angel of
the Lord
encampeth
round
about
them
....
85g
Matthew 7:7
Ask and it
shall be
given to
you 85h
Genesis18:14
Is anything
to hard for
me?
no!!

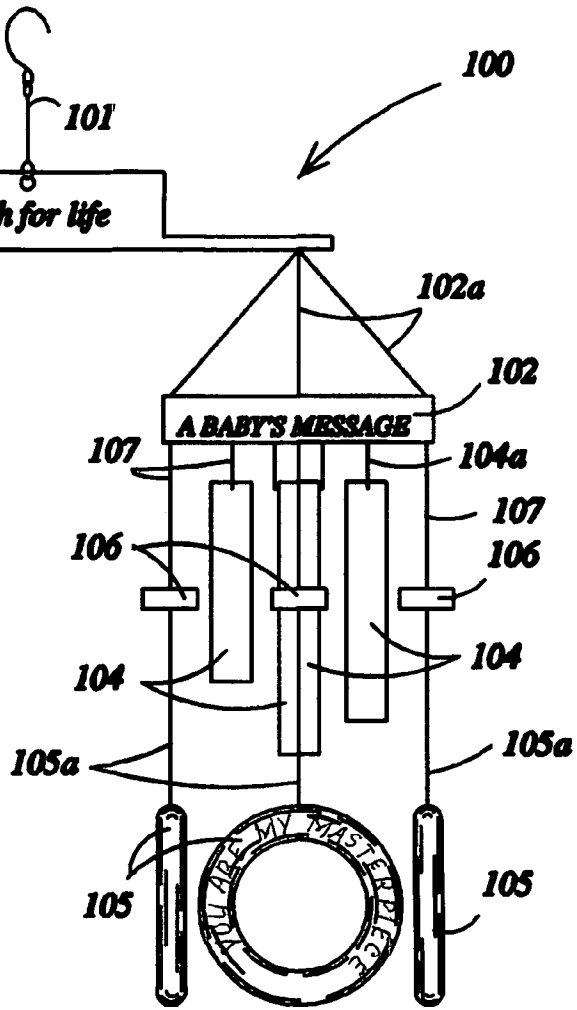
Fig. 10
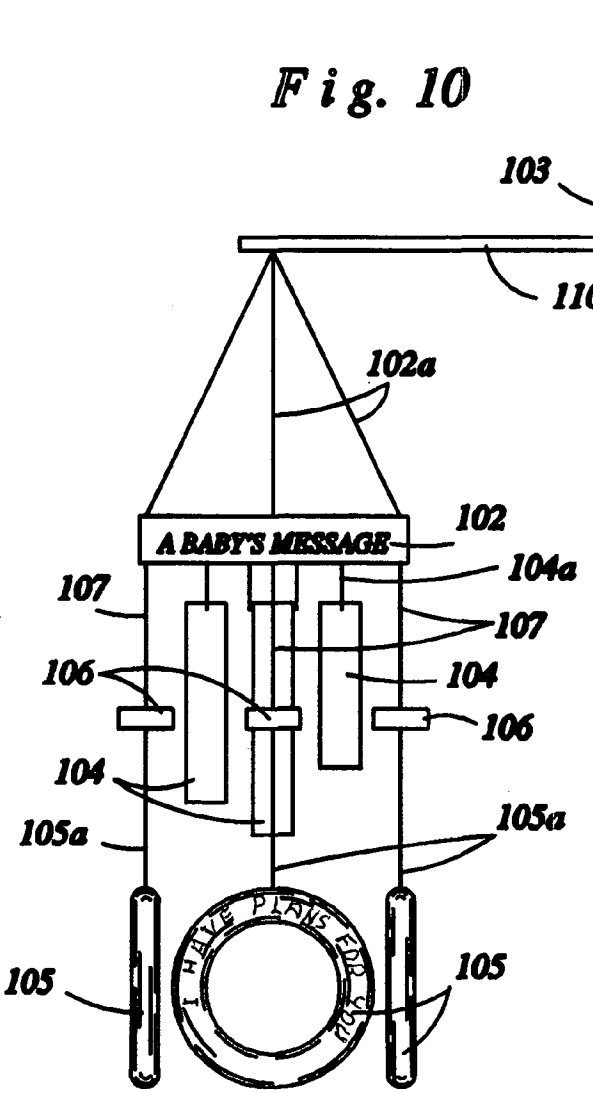
Fig. 11
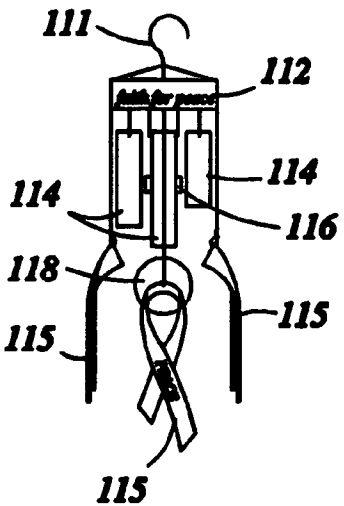

COMBINATION CHIMES AND FAITH BUILDING MESSAGE SYSTEM

BACKGROUND OF THE INVENTION

This invention is directed to multi-tone chimes and more particularly to chimes that also have component means to convey written messages of peace, faith and love for all occasions. In particular the messages are inscribed on the components of the classical chimes and on message bars added to the chime system.

The most commonly used chime is the tube-type chime, where a plurality of spaced apart chimes hang from a main support member or frame. The chimes have an independent swinging movement one from the other when they are contacted. The system includes a striker also hanging from the main support member and a wind vane or clapper vane that is attached to the striker to make it contact the various tube chimes hanging in a circle or along a line. The chimes are of different length to emit different tones when struck by the striker. These commonly used chimes typical of the industry are disclosed in U.S. Pat. Nos. 5,450,779; 5,452,638; 5,315,909; 5,744,736; Des. 250,455; Des. 285,669; Des. 324,000; Des. 373,547; and Des. 404,671 None of these patents have a hanging component or an added portion that includes a greeting or message written thereon.

Another class of commonly used chimes are those having some type of hanging ornament or object to replace the tube-type chime, the top support member, the striker and/or the wind vane. Typical chimes of this class are disclosed in U.S. Pat. Nos. 6,112,382; Des. 272,810; Des. 297,129; Des. 317,419; Des. 346,986; Des. 362,819; Des. 405,709; Des. 419,098; and Des. 432,936. None of these patents of this class have a hanging component or portion that includes a greeting or faith building message. One exception is U.S. Pat. No. Des. 317,419 does say "CHICAGO", but that is really not a message. As defined herein, a message is a series or words that communicates an inspiration or mood as a complete thought.

A further class of chimes are those designed for use indoors where the wind is not present to activate each chime. These chimes have a means to force the striker to contact the chimes. Frequently the chimes are selected to have the some notes of a song and the striker can be programmed to strike the proper sequence of chimes to play the song notes. Typical chimes of this indoor class are disclosed in U.S. Pat. Nos. 6,640,742; Des. 332,924; and Des. 370,183. An excellent opportunity exists with this class of chimes to have the words for a song inscribed on the chimes. However, once again, none of these patents have song words, hanging greetings or faith building messages. One advantage of the indoor type chimes is that they do provide a chime upon which hanging messages can be added without considering the negative effects of the wind trying to wrap the message around the chimes.

There are numerous manufacturers, suppliers and distributors of various chimes of different design. One of the features of particular interest was those chimes that played a particular song or part of a song. The following "Web Sites" were identified as having typical information on commercially produced wind chimes: www.windchimedirectory.com davisblanchard.com; www.christianbook.com; and www.my-occ.com. None of the wind chimes investigated on these and other Web Sites disclosed hanging greetings or faith building messages in combination with the wind chimes. However, an important disclosure is that the manufacturer can choose a combination of chimes that produce specific notes to evoke certain inspirations, emotions, moods or images. For example, the popular "Woodstock Chimes® (www.my-occ.com) have mood & meditation chimes as well as inspirational chimes, such as "Amazing Grace", and others. This makes the chimes excellent as gifts of faith, peace, healing and harmony for all occasions. Examples are: Valentine's day; Birthday; Mother's day; Christmas; Easter; weddings; anniversaries; and recovery from an illness. However, the chimes alone transmit only an audio message where a written message is given by a separate means Accordingly, an object of the present invention is to provide a system of hanging chimes and faith building messages inscribed on hanging message bars for all occasions.

An essential object of the present invention is to provide message bars that are positioned to not disrupt the tuned wind chimes and are easy to read and understood.

Another object of the present invention is to provide at least one embodiment of the present invention suitable as an indoor type of chimes.

Yet another object of the present invention is to provide the greeting or faith building message system as being a coordinated system with the inspiration, emotion, mood or image played by the chimes.

One additional object of the present invention is to provide a gift of peace and harmony to comfort and aid those in need of inspiration and meditation.

SUMMARY OF THE INVENTION

The above objectives are accomplished according to the present invention by providing a combination of multi-tone chimes and hanging message bars. The invention comprises a main support member having a message theme inscribed thereon. A plurality of chimes of different length are suspended vertically from the main support member and are spaced apart to allow independent movement of the chimes. At least one striker is suspended vertically from the main support member to make random contact with the chimes so that each one of the chimes omits a different tone when contacted. Finally, the invention comprises a plurality of message bars suspended vertically from the main support member. The message bars are interspersed with the chimes and have inspirational words, including biblical promises, inscribed thereon.

In another aspect of the invention a faith bar with a hangar is positioned above the main support member for hanging the combination so that the chimes and the message bars extend vertically. A faith building message for healing is inscribed on said faith bar. Also, the wind vane has a life and health message inscribed thereon and the main support member can have an overall purpose message inscribed on the top surface of the main support member.

In a further aspect of the invention at least one wind or clapper vane is suspended from the striker by a vane line for moving the striker to make random contact with the chimes, wherein the wind vane also has a life and health message inscribed thereon.

In a second embodiment of the invention a system is disclosed for providing musical tones to play an inspirational melody and a corresponding faith building message. The system comprises a plurality of chimes suspended vertically from a main support member. Each chime produces a note of the melody. A plurality of message bars interspersed with the plurality of chimes. Each one of the plurality of message bars has a message inscribe thereon; in keeping with the inspirational melody. At least one striker is positioned to randomly strike each one of the plurality of chimes of the melody, wherein cords of the melody are played.

In one aspect of the second embodiment a faith bar with a hangar is positioned above the supports the main support member so that the system of chimes and message bars hang vertically. A faith building message is inscribed on the bar.

In another aspect of the second embodiment, at least one clapper vane is suspended from said striker by a clapper line to move the striker in contact with the chimes. The cords of the melody are played and the clapper vane has a life and health message inscribed thereon.

In yet another embodiment the invention includes a method for providing multi-tone chimes with written faith building messages for all occasions. The method includes a first step of providing a main support member and a faith bar with a hangar. In a second step the method includes using the faith bar and hangar for hanging the main support member in a convenient location. The third step is providing a plurality of chimes and message bars. In a fourth step, the method includes suspending the chimes and the message bars in a preferred arrangement from the main support member using chime lines and message lines. The fifth step is providing at least one striker with an attached wind vane for moving the striker. In a sixth step the method includes suspending the striker and wind vane from the main support member within an inner boundary of said chimes so that at least one striker can contact the chimes. In a final step the method includes inscribing the message bars to provide inspirational words and biblical promises consistent with a melody of the multi-tone chimes.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 10 is an elevation view of a dual message system where there are two combination chimes and message bars of the invention made into a mobile for celebrating a new life where the message bars are in the shape of a circular ring and the message theme expresses biblical promises to an infant; and FIG. 11 is an elevation view of a scaled down version of the combination chimes and message bars of the invention to use where space and function require a small or miniature system to be used.

DESCRIPTION OF A PREFERRED EMBODIMENT

Figure 1A:
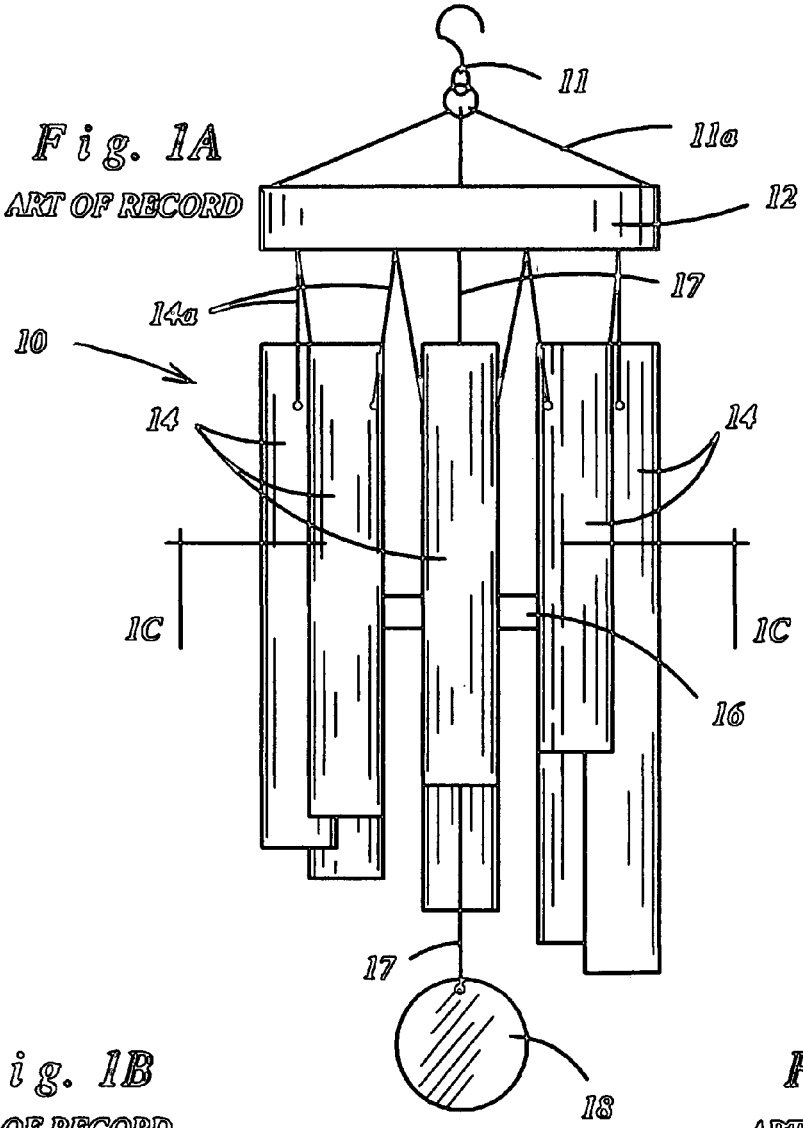
FIG. 1A is a elevation view of a classical chimes of the art to be hung vertically to be activated by the wind forcing a wind vane to move a striker to make random contact with the chimes.

Referring now in more detail to the drawings, the invention will now be described in more detail. Chimes are well known in the art for the last 25 years and more. Various improvements and functional features have been incorporated in the classical chimes over the years. A typical chime of the original art is shown in FIG. 1A to help define the standard components and features of the classical chimes 10. Each chime 14 is in the form of a thin walled cylindrical tube hanging vertically by a chime line 14*a* from a main support member 12. Hangar lines 11 are used to support the total chime system. Depending on the size, thickness and length of the tube and the material the chime is made of, a chime will vibrate at a certain frequency that is an audible tone. By having chimes of different length, the notes in a song or a simple chord of a melody can be produced by simply striking some or all of the chimes. A striker 16 hangs by a striker line 17 from main support member 12 to make random contact with the chimes. The striker is displaced to make contact with a chime by a wind vane 18 hanging from the striker. The wind vane is also commonly called a "clapper" in the art. Both wind vane and clapper vane are used herein. As the wind vane displaces the striker in different directions, the striker makes contact with different chimes.

Figure 1B:
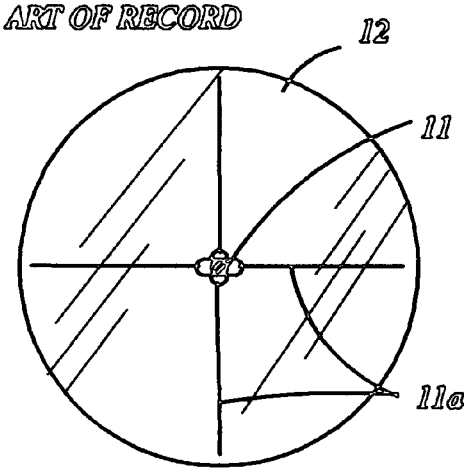
FIG. 1B is a plan view of the typical chimes of the art as illustrated in FIG. 1.

A top plan view of classical chimes 10 is shown in FIG. 1B. The main support member is shown as a solid cylindrical member with a hangar and hangar lines attached on the top side. Other configurations for main support member 12 have also been used in the art including cylinders and frames.

Figure 1C:
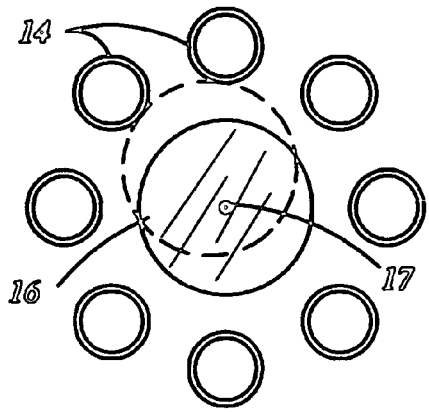
FIG. 1C is a cross-sectional view of the typical chimes of the art taken along line 1C-1C in FIG. 1.

A cross-sectional view of the chimes is shown in FIG. 1C to illustrate a circular chime pattern. The striker is suspended by the striker line within an inner boundary formed by the chimes. Depending on what direction the wind vane moves the striker depends on what chime or chimes are struck by the striker. The result is a series of tones producing beautiful soothing harmonic sounds.

Figure 2A:
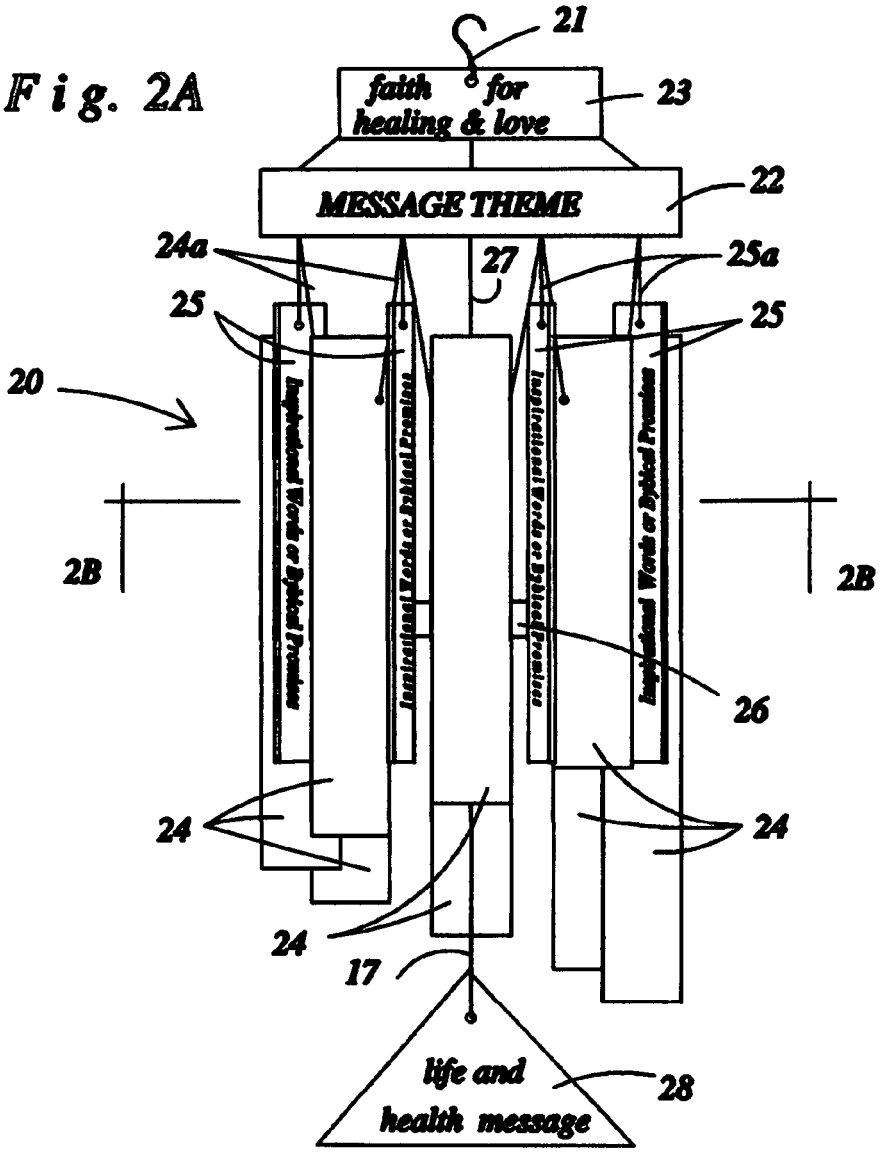
FIG. 2A is an elevation view of a generic chimes and faith building message system of the present invention showing message bars alternating with the chimes in a circular arrangement at the same radius.
Figure 2B:
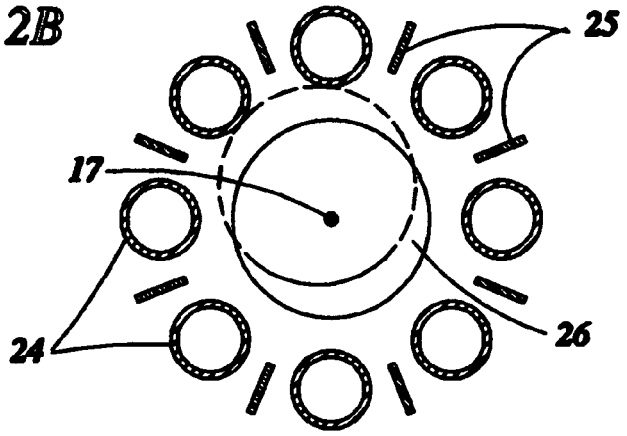
FIG. 2B is a cross-sectional view of the chimes and faith building message system of FIG. 2A taken along line 2B-2B.

The present invention adds written message components to the classical chimes to provide a complete message theme having both musical and thought provoking components. The messages are imprinted on the standard components of the classical chimes and on message bars added to the classical chimes. A typical or generic system of a combination multi-tone chimes and message bars is illustrated in FIG. 2A. The term "bars" is used herein for any shape that the message bars may have including crosses, hearts, rectangles and the like. The shape of the message bars is not critical to the scope of the invention. The generic system 20 is shown to have hanging message bars 25 in addition to multi-tone chimes 24 hanging from main support member 22. Main support member has a "message theme" imprinted thereon. The message bars are shown in this generic embodiment to be located between each chime of the circular array of chimes, as illustrated in FIG. 2B. The message bars are positioned to provide minimum interference to the chimes when they are struck by striker 26; forced to move by a wind or clapper vane 28. The striker is supported from the main support member by striker line 17 and the wind vane is supported from the striker by an extension of the striker line. The generic embodiment has a "life and health message" imprinted on the wind vane. The shape of the wind vane can be any shape consistent with the life and health message. The chimes are suspended from main support member 22 by chime lines 24*a* and each message bar is suspended from the main support member by a message line 25*a*. The preferred generic message imprinted on the message bars are "inspirational words or biblical promises" taken from the bible. The shape of the message bars can be selected to be consistent with the message theme; including rectangular shaped bars (FIGS. 6A-6H), bars in the shape of a cross (see FIGS. 7A-7H), bars shaped like a heart (see FIGS. 8A-8H) and the like.

In another aspect of the invention, a faith bar 23 is added above the main support member to convey a message of the combination chimes and message bars. This faith bar has a message imprinted thereon and referred to herein as a "faith for healing and love message". Suspended below the faith bar by faith bar lines 23*a* is the main support member that carries the other components of the generic system. A hangar 21 is added to hang generic system 20 vertically in a preferred location to have some exposure to the wind.

Figure 3A:
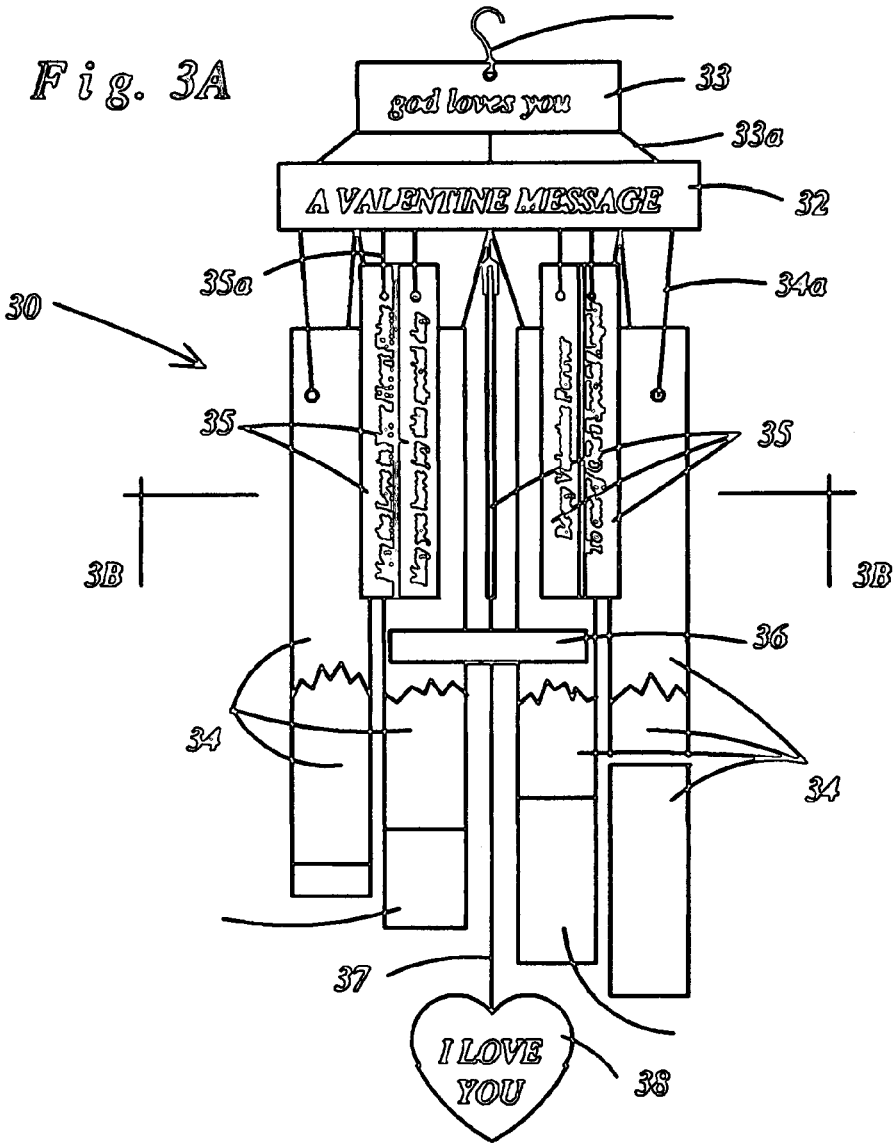
FIG. 3A is an elevation view of the chimes and faith building message system of the present invention being a valentine message having message bars alternating with chimes in a circular arrangement with the message bars at a smaller radius than the radius of the chimes.

In one embodiment of the invention the message theme can be "A VALENTINE MESSAGE", as illustrated in partial elevation view of FIG. 3A. This valentine system 30 is again a combination of the classical chimes 34 and message bars 35. The components of the classical chimes, as previously discussed, remain with this aspect of the embodiment. Main support member 32 has the message theme imprinted thereon. Chimes 34 are, once again, in a circular pattern hanging by chime lines 34*a* from the main support member. Striker 36 and wind or clapper vane 38 are again supported from the main support member by a striker line 37. The wind vane is in the shape of a heart for this aspect of the invention and has a life message imprinted thereon. A typical life message can be such a phrase as "I Love You". Message bars 35, hanging by message lines 35*a* from the main support member, have inspirational words consistent with this message theme, as discussed below. However, this embodiment has the message bars located to the interior of the circular array of chimes, as illustrated in the cross-sectional view of FIG. 3B. The message bars are of a shortened length to allow striker 36 to move freely without contacting the message bars. The upper portions of the front four chimes have been removed to illustrate the extent of the message bars. Faith bar 33 has a faith building for love message consistent with the valentine message theme; including such a phrase as "God Loves You". Hook 31 provides a means to hang the valentine message.

Figure 3B:
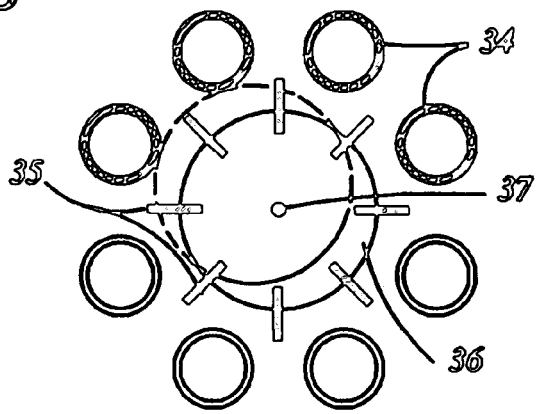
FIG. 3B is a cross-sectional view of the chimes and faith building message system of FIG. 3A taken along line 3B-3B.

The message bars for this valentine message theme are imprinted with typical valentine phrases, such as: be my valentine; yours forever; to one of God's special angels; may the love in your heart shine; may you have joy this special day; and the like. Eight message bars are illustrated in FIGS. 3A and 3B. The number of message bars can be more or less than eight consistent with the scope of this invention. The preferred number of message bars is the same number as there are chimes.

Figure 4A:
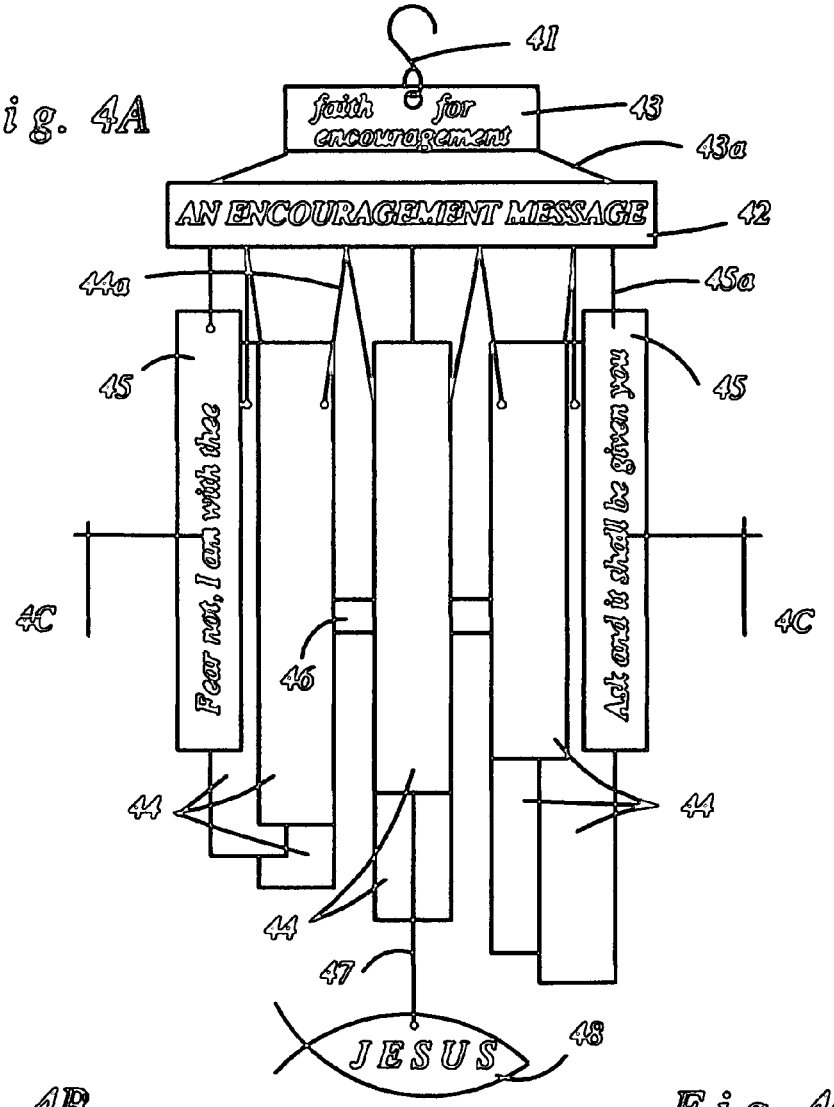
FIG. 4A is a front elevation view of the chimes and faith building message system of the present invention being an encouragement message having message bars laterally disposed on both sides from the circular arrangement of chimes
Figure 4B:
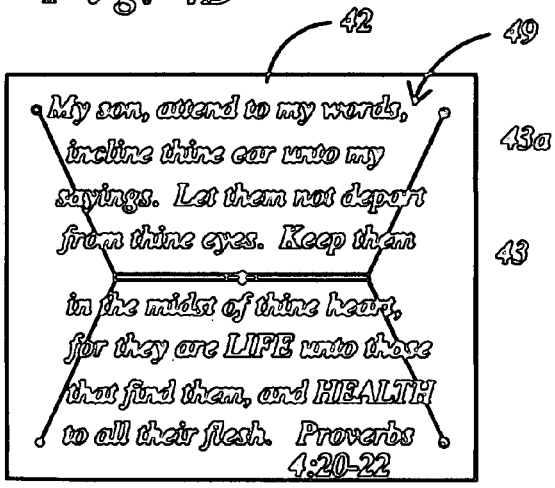
FIG. 4B is a top plan view of the chimes and faith building message system of FIG. 4A showing a purpose message inscribed on the top surface of the main support member
Figure 4C:
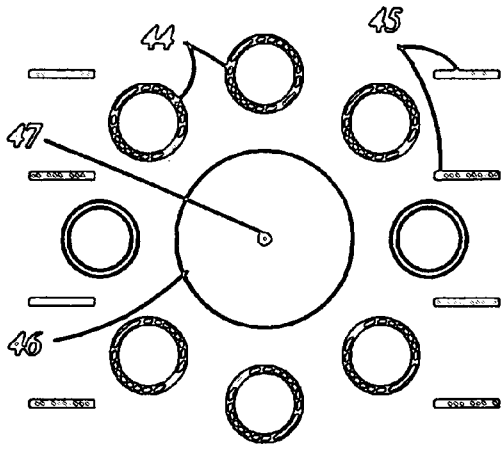
FIG. 4C is a cross-sectional view of the chimes and faith building message system of FIG. 4A taken along line 4C-4C.

In another embodiment of the invention the message theme can be "AN ENCOURAGEMENT MESSAGE", as illustrated in the elevation view of FIG. 4A. This encouragement system 40 is again a combination of the classical chimes 44 and message bars 45. The components of the classical chimes remain with this aspect of the embodiment; including main support member 42, chimes 44, striker 46 and wind or clapper vane 48. Main support member 42 has a rectangular shape for this embodiment and has the message theme imprinted on at least one vertical edge. A purpose message is also imprinted on a top surface 49 of the main support member, as illustrated in FIG. 4B. Chimes 44 are, once again, in a circular pattern hanging by chime lines 44*a* from the main support member. Striker 46 and wind vane 48 are supported from the main support member by striker line 47. The wind vane is shown in the shape of a fish for this aspect of the invention and has a life message imprinted thereon. A typical life message can be a phrase or word, such as "JESUS". Message bars 45, hanging by message lines 45*a* from the main support member are positioned at both lateral sides of the chimes. The cross-sectional view of FIG. 4C shows the location of hanging message bars 45 with respect to the circular array of chimes 44 for this embodiment of the invention. The message bars have inspirational words consistent with this message theme, as discussed below. Faith bar 43 has a faith for healing message imprinted thereon consistent with the encouragement message. Hook 41 provides a means to hang the encouragement system in a preferred location.

Figures 8A, 8B, 8C, 8D, 8E, 8F, 8G, 8H:
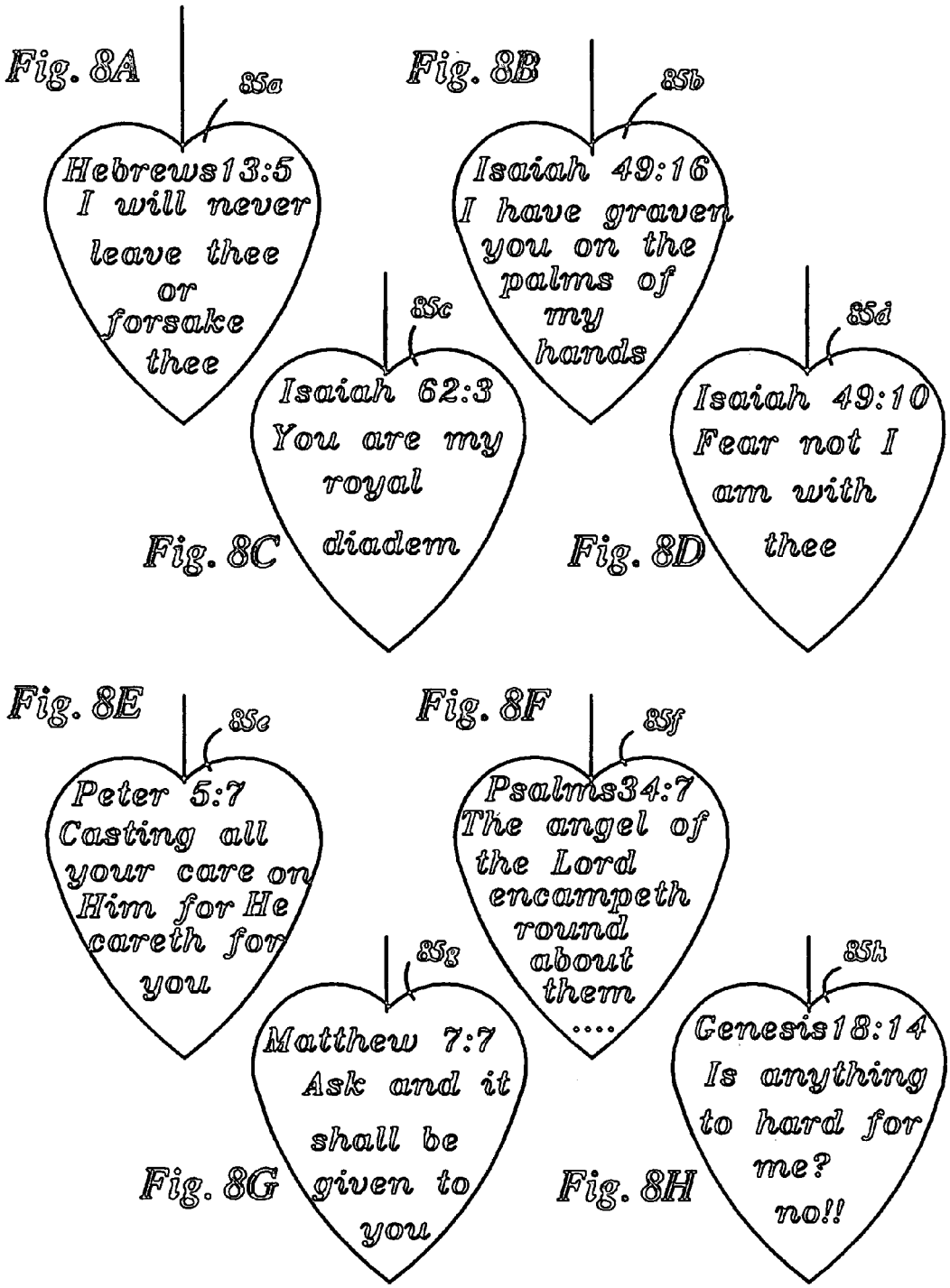
FIGS. 8A-8H are elevation views of message bars for a third message bar set for the chime and faith building message system where the message bars are in the shape of a heart and the message theme expresses faith building for encouragement.
Figure 9A:
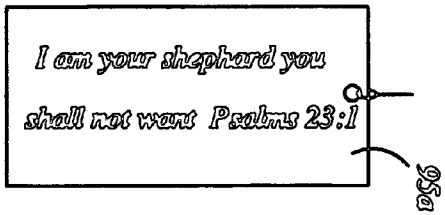
FIGS. 9A-9H are elevation views of message bars for a fourth message bar set for the chimes and faith building message system where the message bars are in the shape of a rectangle and the message theme expresses faith for promises.
Figure 9B:
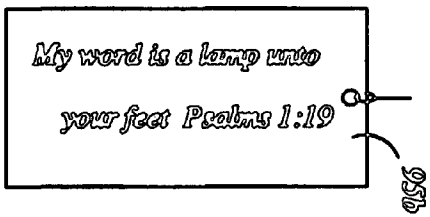
Figure 9C:
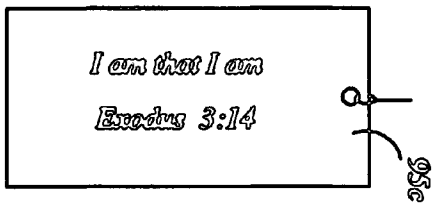
Figure 9D:
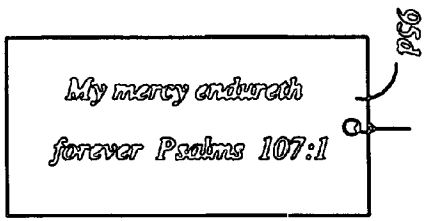
Figure 9E:
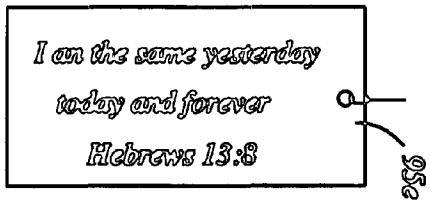
Figure 9F:
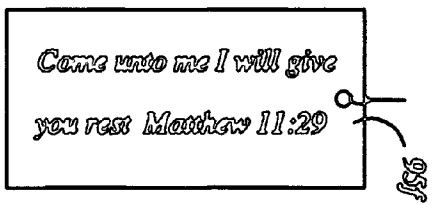
Figure 9G:
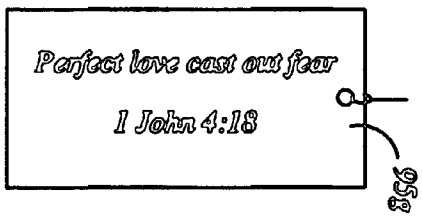
Figure 9H:
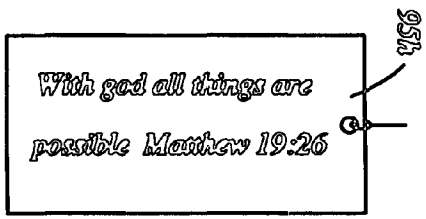

The message bars for this encouragement message theme are imprinted with typical valentine phrases, such as those shown on the heart shaped message bars of FIGS. 8A-8B. Other message themes can be used with this configuration of chimes and message bars. Eight message bars are illustrated in FIGS. 4A and 4C. Once again, the number of message bars can be more or less than eight consistent with the scope of this invention.

Figure 5A:
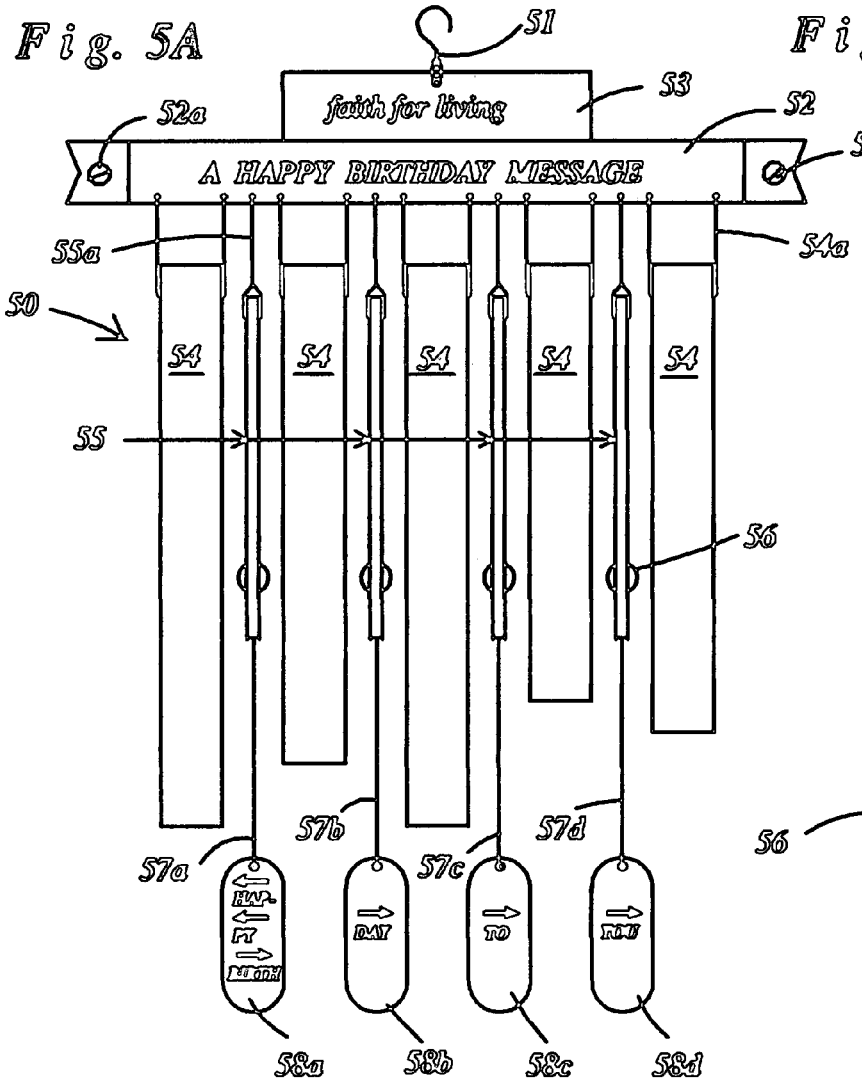
FIG. 5A is a front elevation view of the chimes and faith building message system of the present invention being a birthday message having spaced apart chimes and message bars alternating along a linear path and the message bars each having a striker.
Figure 5B:
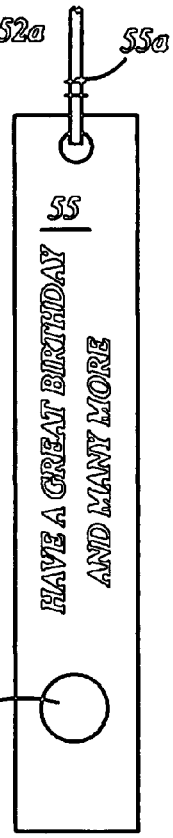
FIG. 5B is an elevation view of a typical message bar of the chimes and faith building message system of FIG. 5A showing the striker made integral with a message bars for contacting a respective chime.
Figure 5C:
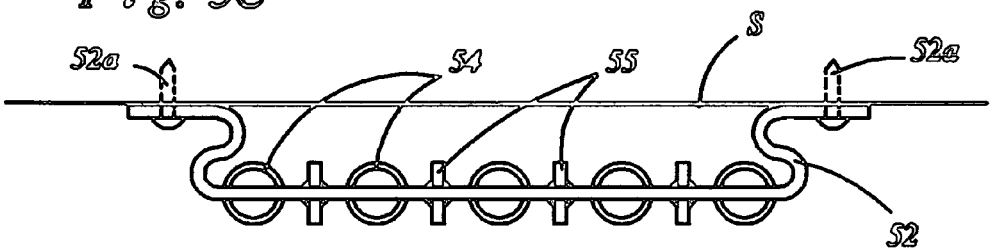
FIG. 5C is a top plan view of the chimes and faith building message system of FIG. 5A showing a main support member attached to a vertical surface.
Figure 6A:
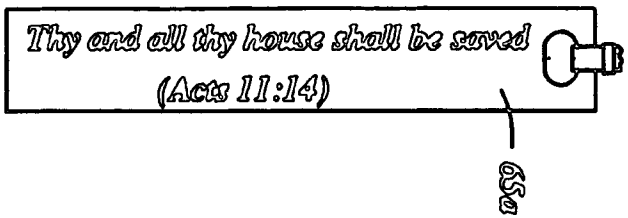
FIGS. 6A-6H are elevation views of message bars for a first message bar set for the chime and faith building message system where the message bars are in the shape of an elongated rectangle and the message theme expresses faith building for household salvation.
Figure 6B:
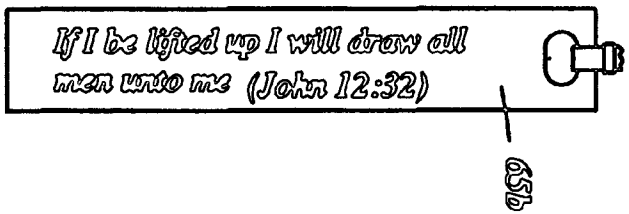
Figure 6C:
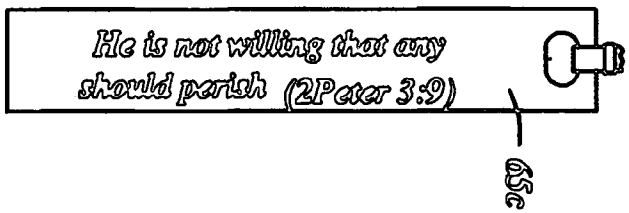
Figure 6D:
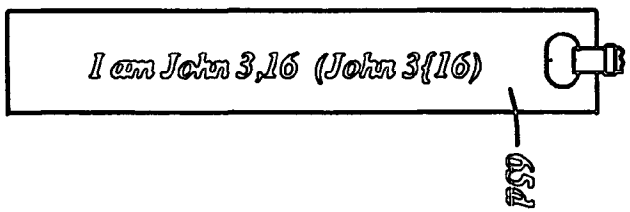
Figure 6E:
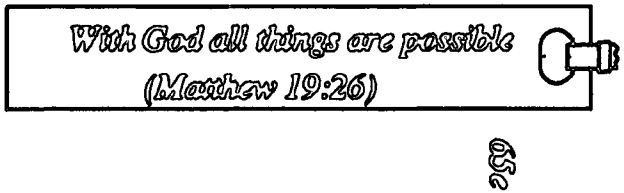
Figure 6F:
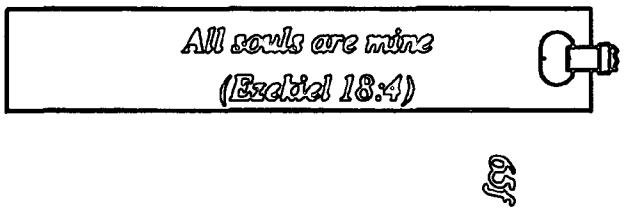
Figure 6G:
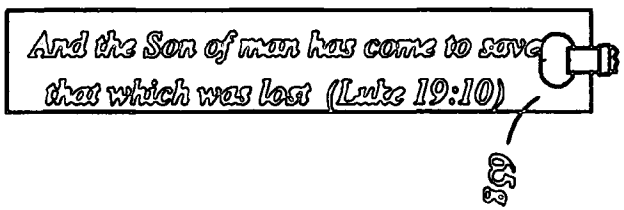
Figure 6H:
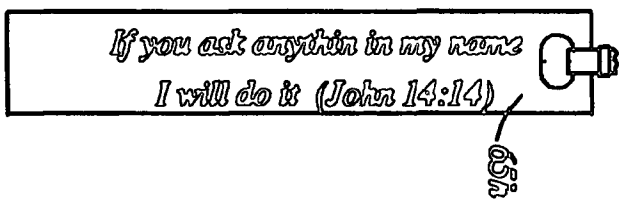
Figures 7A, 7B, 7C, 7D, 7E, 7F, 7G, 7H:
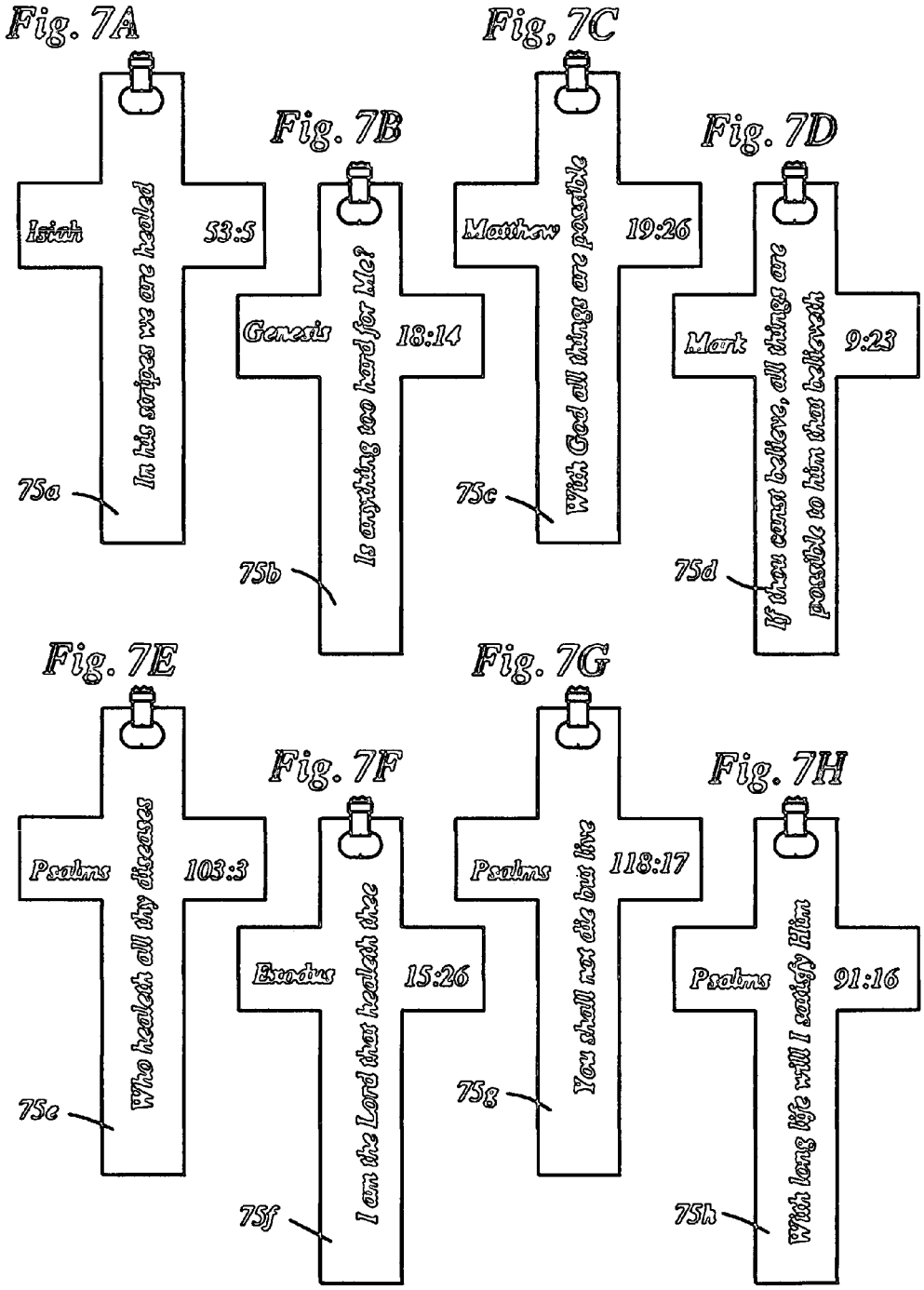
FIGS. 7A-7H are elevation views of message bars for a second message bar set for the chime and faith building message system where the message bars are in the shape of a cross and the message theme expresses faith building for healing.

In a further embodiment of the invention the message theme can be "A HAPPY BIRTHDAY MESSAGE", as illustrated in the elevation view of FIG. 5A. This birthday system 50 is again a combination of chimes 54 and message bars 55. The components of the classical chimes remain with this aspect of the embodiment; including main support member 52 and hanging chimes 54. However, the chimes are hanging in a linear array from a bar shaped main support member 52. Message bars 55, hanging by message lines 55*a* from the main support member, are positioned in each space between adjacent chimes. A plurality of strikers 56*a*-56*d* and corresponding clapper vanes 58*a*-58*d* are required for the linear array of chimes. In this embodiment the strikers are made integral with message bars 55 and each clapper vane is hanging from a respective message bar by a clapper line 57. Main support member 52 has a bent bar shape for this embodiment and has the message theme imprinted on a vertical face of the main support member. The main support member can be mounted on a vertical surface "S" using fasteners 52*a* and 52*b*, as shown in FIG. 5C. This embodiment is very well adapted to use indoors where there is no wind. The strikers are forced by hand using the clapper vanes to make contact with the chimes.

In a typical application of this embodiment, the length of each chime can be selected to play the notes of a well known melody; such as "hap-py birth day to you". The five notes from the happy birthday chimes can be played by hand like a xylophone. The clapper vanes have the words of the melody imprinted thereon with an arrow to indicate which direction to move the message bar and striker so the strikers can strike the correct notes going from left to right. An elevation view of a typical message bar is shown in FIG. 5B. The message imprinted on each message bar is consistent with the birthday message theme. The top plan view of FIG. 5C shows the location of hanging message bars 55 with respect to the linear array of chimes 54 for this embodiment of the invention. Faith bar 53 has a faith for living message imprinted thereon consistent with the happy birthday message. Four message bars are shown along with five chimes in FIG. 5A. The number of message bars can be more or less than four consistent with the scope of this invention and the number of chimes.

The messages printed on the message bars can vary within the scope of this invention. A message theme can be selected to make the combination chimes and message bars fit the occasion. The messages can be inspirational words, biblical promises, celebrations of anniversaries, corporate advertisements, and general words of faith building for healing and love to convey a message theme to those receiving the chimes. Examples of message sets are given in FIGS. 6-9 for different message themes.

The message set of FIGS. 6A-6H is intended to give "faith for encouragement or household salvation". The message bars for this message set are in the form of an elongated rectangle. Each message bar 65*a* thru 65*h* has a verse from the bible in support of this message theme. The message theme imprinted on a vertical surface of the main support member can be "an encouragement message". The preferred system for using this elongated rectangular message set is encouragement system 40 of FIG. 4A, the valentine system 30 of FIG. 3A, or generic system 20 of FIG. 2A.

The message set of FIGS. 7A-7H is intended to give "faith for healing". The message bars for this message set are shaped in the form of a cross. Other shapes are within the scope of the invention; as the shape of the message bars is not critical to the scope of the claimed invention. The message theme imprinted on a vertical surface of the main support member can be "a healing message". Each message bar 75*a* thru 75*h* has a verse from the bible in support of this message theme. The preferred system for using this cross message set is encouragement system 40 of FIG. 4A The message set of FIGS. 8A-8H is intended to give "faith for encouragement". Each message bar 85*a* thru 85*h* for this message set are shaped in the form of a heart. Other shapes of the message bars are also within the scope of this message theme. The message theme imprinted on a vertical surface of the main support member can be "an encouragement message". Each message bar 85*a* thru 85*h* has a verse from the bible in support of this message theme. The preferred system for using this heart message set is encouragement system 40 of FIG. 4A or valentine system 30 of FIG. 3A.

The message set of FIGS. 9A-9H is intended to give "faith for promises". Each message bar 95*a* thru 95*h* for this message set are shaped in the form of a rectangle. Other shapes of the message bars are also within the scope of this message theme. The message theme imprinted on a vertical surface of the main support member can be "a promises message". Each message bar 95*a* thru 95*h* has a verse from the bible in support of this message theme. The preferred system for using this rectangular message set is encouragement system 40 of FIG. 4A or generic system 20 of FIG. 2A.

In a separate embodiment of the present invention a dual arrangement of the combination chimes and message bars is disclosed, as illustrated in FIG. 10. A dual system 100 is configured to provide a mobile to hang in a child's room for a child to enjoy. There are two combination chimes 104 and message bars 105 of the present invention provided in the dual system. A spreader bar 110 with an integral faith bar 103 supports the dual system. Hangar 101 is located to support the spreader bar horizontally according to the relative weight of each combination, and a swivel joint allows the dual system to rotate about the hangar; as with a typical mobile in the art. The message theme for this embodiment is "A BABY'S MESSAGE" imprinted on the each one of the main support members 102. A plurality of strikers 106 hang from the main support members by striker lines 107. In this dual system embodiment the message bars hang from the strikers using message lines 105*a*. Movement of a message bar makes the respective striker contact an associated chime. An example of biblical promises that can be used on the eight message bars are as follows:

Before I formed you in the womb I knew you, Jeremiah 1:5;

You are fearfully and wonderfully made, Psalms 139:4;

I have chosen you before the foundation of the world, Ephesians 1:4;

You are my masterpiece, Ephesians 2:10;

Suffer little children come unto me, Matthew 19:14;

I have plans for you, Jeremiah 29:11;

I knit you together in your mother's womb, Psalms 139:13; and

All things were made by me "I MADE YOU", 1 John 1:3

These biblical promises are consistent with the message of faith bar 103 and the message theme of the main support members. Other biblical promises can be used within the scope of this invention.

Chimes are used for many different purposes. The purpose may require the overall size of the chimes to be reduced in keeping with their use. A miniature chime is illustrated in FIG. 11. This miniature system has all the components of the larger classical chimes including main support member 112 and chimes 114 plus the message bars 115 of this invention. The message bars for the example show are in the shape of a ribbon with a short "peace" message printed thereon. Some of the classical uses of miniature chimes in the art include miniature earrings, charm bracelets, key chains and those hung by a hangar 111 from the rear view mirror of a vehicle. Once again these applications do not include the message bars improvement of this invention. The use of materials for the components of the combination system are somewhat arbitrary. The chimes of the art are primarily made of wood glass or metal. The same materials for this invention are preferred, but other materials can be used within the scope of the invention that result in a tone sound when struck by a striker. The main support member can be a metal framework or the preferred wooden block typical in the art. The striker is preferably made of a metal or wood. The lines supporting the various components are preferably of a weather resistant nylon, or similar material. The message bars are preferably made of a material compatible with the material of the chimes. The material of the message bars is selected from any family of materials including paper, cloth, plastic, metal and wood. Where the use is outside the preferred material for the message bars is plastic or metal. Special care should be used for any materials and components that may be accessed by an infant, such as the mobile of the dual system of FIG. 10. Generally speaking, access by an infant is not recommended.

While a preferred embodiment of the invention has been described using specific terms an a particular prior art reference, such description is for illustrative purposes only, and it is to be understood that changes and variations may be made without departing from the spirit or scope of the following claims.

What is claimed is:

1. A combination of multi-tone chimes and hanging message bars comprising:

a main support member having a message theme inscribed thereon;

a plurality of chimes of different length suspended vertically from said main support member and spaced apart to allow independent movement of said chimes;

at least one striker suspended vertically from said main support member to make random contact with said chimes, so that each one of said chimes emits a different tone when contacted;

a plurality of message bars suspended vertically from said main support member, wherein said message bars are interspersed with said chimes and have inspirational words including biblical promises inscribed thereon; and a faith bar with a hangar positioned above said main support member for hanging the combination so that said chimes and said message bars extend vertically and wherein a faith building message for healing is inscribed on said faith bar.

2. The combination chimes and message bars of claim 1, including:

at least one wind vane suspended vertically from said at least one striker for moving said striker, wherein said wind vane has a life and health message inscribed thereon.

3. A combination of multi-tone chimes and hanging message bars comprising:

a main support member having a message theme inscribed thereon wherein said main support member has a top surface with an overall purpose message inscribed thereon;

a plurality of chimes of different length suspended vertically from said main support member and spaced apart to allow independent movement of said chimes;

at least one striker suspended vertically from said main support member to make random contact with said chimes, so that each one of said chimes emits a different tone when contacted;

a plurality of message bars suspended vertically from said main support member, wherein said message bars are interspersed with said chimes and have inspirational words including biblical promises inscribed thereon.

4. The combination chimes and message bars of claim 1, wherein said plurality of chimes are suspended by chime lines in a circular pattern from said main support member with said a single striker suspended vertically by a striker line from said main support member within an inner boundary of said chimes.

5. The combination chimes and message bars of claim 4, wherein said plurality of message bars are suspended by message lines so that they hang in a circular arrangement alternating with said chimes.

6. The combination chimes and message bars of claim 4, wherein said plurality of message bars are suspended by message lines so that said message bars are spaced apart in a circular pattern to the interior of said circular arrangement of said chimes.

7. The combination of chimes and message bars of claim 4, wherein said message bars are suspended by message lines to be spaced apart laterally from said circular pattern of said chimes.

8. The combination of chimes and message bars of claim 1, wherein said chimes are made of a metallic material and said message bars are made of a non-metallic material.

9. The combination of chimes and message bars of claim 1, wherein said chimes are made of a non-metallic material and said message bars are made of a metallic material.

10. The combination of chimes and message bars of claim 1, wherein said chimes and said message bars are made of the same material.

11. A system for providing musical tones to play an inspirational melody and a corresponding faith building message comprising:

a plurality of chimes suspended vertically from a main support member wherein each chime produces a note of the melody;

a plurality of message bars also suspended vertically and interspersed with said plurality of chimes, wherein each one of said plurality of message bars has a message inscribe thereon in keeping with the inspirational melody;

a faith bar with a hangar positioned above and supporting said main support member so that the system of chimes and message bars hang vertically, wherein a faith building message is inscribed on said faith bar; and at least one striker positioned to strike each one of said plurality of chimes of the melody, wherein cords of the melody are played.

12. The system of claim 11, including at least one clapper vane suspended from said striker by a clapper line to move said striker in contact with said chimes, wherein said clapper vane has a life and health message inscribed thereon.

13. The system of claim 11, wherein said plurality of chimes are suspended by chime lines in a circular pattern and said message bars are also suspended in a circular pattern to avoid contact with said chimes.

14. The system of claim 11, wherein said plurality of chimes are suspended vertically in a spaced apart linear arrangement and said plurality of message bars are also arranged in the same linear pattern to alternate with said chimes, wherein the system can be mounted on a vertical surface.

15. The system of claim 14 wherein each one of said plurality of message bars contains a striker built integrally with said message bar to comprise a combined message bar and striker, wherein said each combined message bar and striker has a clapper vane suspended by a clapper line from said message bar for moving each striker to make contact with a respective chime.

16. The system of claim 11 wherein said message bars are each supported from a respective striker using a message line to provide a clapper vane to help move said respective striker in contact with a respective chime.

17. A method for providing multi-tone chimes with written faith building messages for all occasions, including the steps of:

a) providing a main support member and a faith bar with a hangar;

b) using said faith bar and hangar for hanging said main support member in a convenient location;

c) providing a plurality of chimes and message bars;

d) suspending said chimes and said message bars in a preferred arrangement from said main support member using chime lines and message lines;

e) providing at least one striker with an attached wind vane for moving said striker;

f) suspending said striker and wind vane from said main support member within an inner boundary of said chimes so that said at least one striker can contact the chimes; and g) inscribing said message bars to provide inspirational words and biblical promises consistent with a melody of the multi-tone chimes.

18. The method of claim 17, further including the steps of:

a) inscribing the faith bar to provide healing and encouragement messages;

b) inscribing the main support member to provide a theme message along one edge and a purpose message on the top; and c) inscribing the wind vane to provide a life and health message.

* * * * *